US006321400B1

(12) United States Patent
Gulino

(10) Patent No.: US 6,321,400 B1
(45) Date of Patent: Nov. 27, 2001

(54) AIR MATTRESS SLEEPING BAG

(76) Inventor: Salvatore R. Gulino, 187 Harvard St., Malden, MA (US) 02148

( * ) Notice: Subject to any disclaimer, the term of this patent is extended or adjusted under 35 U.S.C. 154(b) by 0 days.

(21) Appl. No.: 09/389,628

(22) Filed: Sep. 3, 1999

(51) Int. Cl.[7] ..... A47C 29/00

(52) U.S. Cl. ..... 5/413 AM; 5/413 R; 5/419; 5/706

(58) Field of Search ..... 5/413 AM, 413 R, 5/706, 655.3, 419

(56) References Cited

U.S. PATENT DOCUMENTS 1,648,373 * 11/1927 Vilas ..... 5/413 AM
4,091,482 5/1978 Malcolm .
4,862,533 9/1989 Adams, III .
4,896,387 * 1/1990 Malcolm et al. ..... 5/413 AM
5,471,687 * 12/1995 Vierra ..... 5/413 AM
5,528,779 * 6/1996 Lee et al. ..... 5/413 AM
5,553,339 9/1996 Thomas .
5,640,725 6/1997 Ando et al. .
5,669,088 * 9/1997 McNamee ..... 5/413 AM

* cited by examiner

*Primary Examiner*—Lynne H. Browne
*Assistant Examiner*—Fredrick Conley
(74) *Attorney, Agent, or Firm*—D. Michael Burns

(57) ABSTRACT

An air inflatable sleeping bag assembly for insulating and supporting an individual in a spaced relationship relative to the ground. The sleeping bag including a self contained powered air inflation device. The assembly having pneumatic mattress portions that are individually inflated and provision for alternate support when one or more of the pneumatic chambers is damaged or defective. The assembly capable of converting to a full air mattress when not in use as a sleeping bag.

18 Claims, 4 Drawing Sheets

AIR MATTRESS SLEEPING BAG

BACKGROUND OF THE INVENTION

1. Field of the Invention

The present invention relates generally to sleeping bags and more particularly an air cushioned sleeping bag that can alternatively be used as a full sized air mattress having a battery powered inflation device.

2. Description of the Prior Art

Air cushioned sleeping bags are well known and generally used for outdoor camping activities. Conventional devices support the individual on a pneumatic bed which is coupled to the bottom of a sleeping bag assembly. The pneumatic bed protects and insulates the individual from cold, rough or uneven terrain. Many prior art patents are compartmentized as relating to pneumatic chambers whereby portions of the device can be inflated at varying degrees of firmness. Provisions are generally included for rapid deflation for portability.

U.S. Pat. No. 5,528,779 issued to Lee et al. on Jun. 25, 1996, discloses an air-cushioned sleeping bag having a bottom air cushioned portion. The air cushioned portion having dual compartments, one to support the torso of the individual and one to support the neck and head. A cover member is integrally attached to complete the device. It would not be possible to utilize this device as both an air cushioned sleeping bag and alternately a full size air mattress.

U.S. Pat. No. 5,640,725 issued to Ando et al. on Jun. 24, 1997, describes a steeping bag having a mattress portion and a coverlet portion. A removable air mattress is inserted wisthin the mattress portion. There is an abundance of such devices in the prior art that have the air mattress removably inserted. Nothing is taught in which the device could also be used as a full mattress.

U.S. Pat. No. 4,862,533 issued to Adams III, on Sep. 5, 1989, teaches of an inflatable air mattress design that is slidably disposed within a zipper controlled pocket of the bag. This patent most resembles the conventional non-pneumatic sleeping bags.

Roy C. Thomas discloses an adjustable air mattress sleeping bag in his U.S. Pat. No. 5,553,339 issued on Sep. 10, 1996. The pneumatic support assembly of this patent includes a plurality of elongated flexible air tubes which can be individually pressurized to a desired firmness. Many prior art patents address the need to have a plurality of air chambers to accommodate the different needs of individuals. Again the prior art does not show a patent capable of being alternately used as a convention air mattress.

U.S. Pat. No. 4,091,482 issued to Malcolm on May 30, 1978 shows a mat having multiple layers of impermeable material adapted to inflation as a full size mattress if so desired. However, here this patent is not capable of alternately inflating only half the assembly and using the unflatable portion as the coverlet.

While these devices fulfill their respective, particular objectives and requirements, the aforementioned patents do not disclose air mattress sleeping bag that can be used both as a conventional air supported sleeping bag and alternatively as a full size air mattress. None of the devices can be employed wherein either of the coverlet portions can be used as the air support portion in the event that the other had a puncture or malfunction. None of the above inventions, taken either singularly or in combination, are seen to describe the instant invention.

SUMMARY OF THE INVENTION

The invention is an air supported sleeping bag that is designed to be alternatively used as a full size air mattress. Part of the inventive concept is that when the invention is in use as a conventional sleeping bag, it contains a support mattress portion and a coverlet portion, whereby either portion can alternatively be substituted for the other. This would be of particular importance when one side of the support chamber is punctured or otherwise damaged. The coverlet portion having chambers that can be inflated would then assume the support portion while the damaged portion would now be the coverlet portion. As stated above, the main use for sleeping bags is for outdoor use, however there is an entire prior art devoted to air mattresses designed for use in the home or whatever. The present invention can just as easily be used as a full size air mattress by merely inflating all the chambers. The insulated sleeping bag material portion can then be used to sleep on or it can be removed thereby making the invention strictly an air mattress. It is also feasible to use a second unit which could be fastened to the first unit and used as a cover.

The present invention utilizes well known materials, such as down feathers or polyfillers, for both the sleeping bag portions and the inflatable portions. The inflatable portions consist of four chambers. Two chambers for torso support and two chambers for neck and head support. When in use as a sleeping bag, only one of the torso support chambers and only one of the neck and head support chambers are utilized. The other two are held in reserve in the event of a malfunction in the other. The only time that all four will be inflated will be when the assenbly is to be used as a full air mattress. The bedding portion can be either permanently attached to the inflatable portion or else conventional adhesives or velcro-like fasteners can be employed to removably attach them.

The present invention will have included in an interior pocket an inflation device. This device will be powered by a pair of conventional alkaline batteries, and have means for attachment to air vents in each of the four air chambers. The ability to inflate the assembly without electricity would be most important on camping trips, however the inflation device will also have an electrical cord for use when electricity is available.

It is therefore an object of the present invention to provide a new air mattress sleeping bag assembly which has many of the advantages of the prior art portable bedding devices mentioned heretofore and many novel features that result in an air mattress sleeping bag which is not anticipated, rendered obvious, suggested, or even implied by any of the prior art portable bedding devices, either alone or any combination thereof.

It is an object of the present invention to provide a new air mattress sleeping bag that may be economically manufactured.

It is a further object of the present invention to provide a new air mattress sleeping bag that can alternatively be used as a full mattress.

An even further object of the present invention is to provide an air mattress sleeping bag that has two separate and distinct pneumatic assemblies, each with torso and head support chambers, whereby an alternate air support assembly is on standby in case of malfunction of the other.

Still another object of the present is to provide a new air mattress sleeping bag which has a battery operated inlation device contained within the assembly.

Yet another object of the present invention is to provide a new air mattress sleeping bag with the air mattress portion integral with the sleeping bag portion for comfortably supporting the individual with respect to rough or uneven terrain and prevention the air mattress portion from slipping off.

These together with other objects of the invention, along with the various features of novelty which characterizes the invention, are pointed out with particularity in the claims annexed to and forming part of the disclosure. For a better understanding of the invention, its advantages and the specific objects attained by its users, reference should be had to the accompanying drawings and descriptive matter in which there is illustrated the preferred embodiment of the invention.

DETAILED DESCRIPTION OF THE PREFERRED EMBODIMENT

Figure 1:
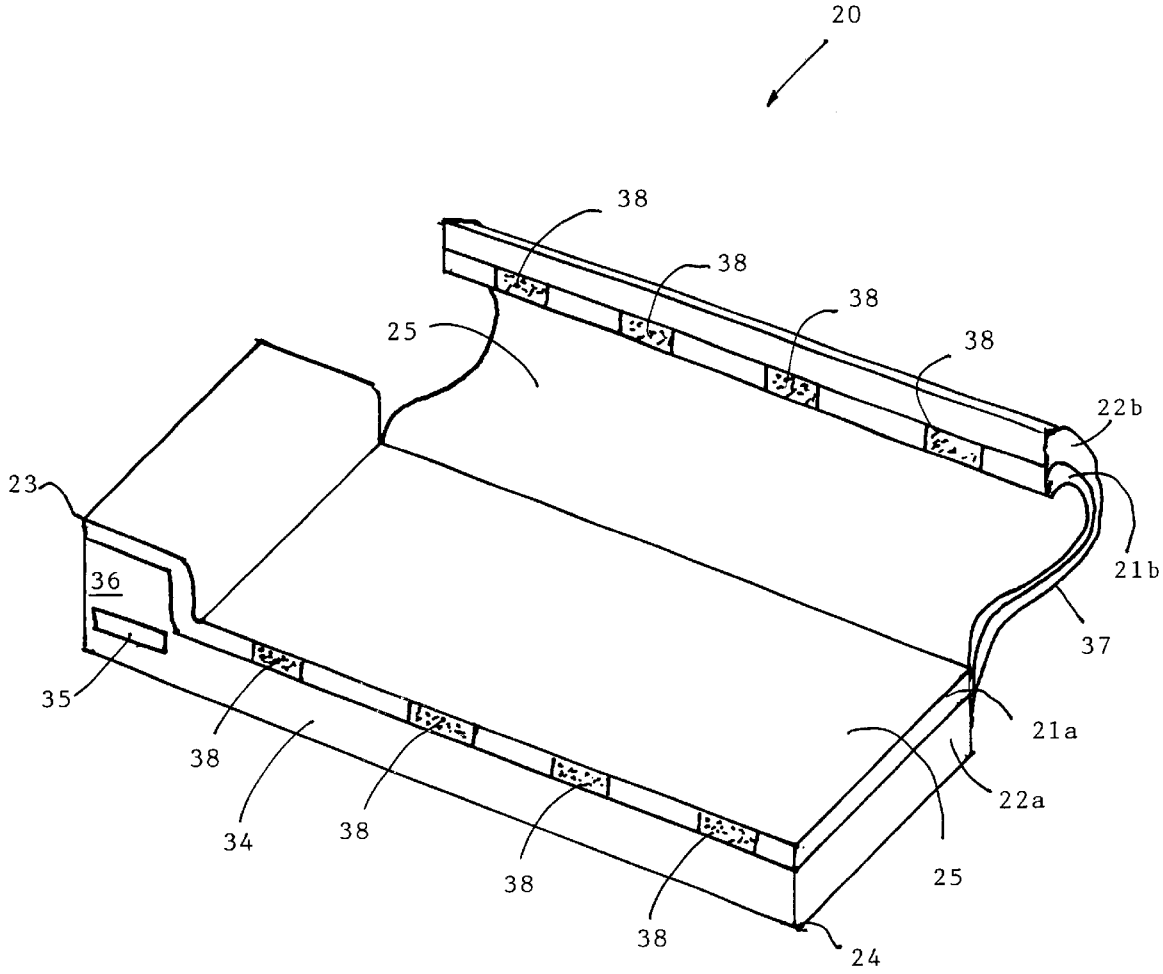
FIG. 1 is a perspective view of the sleeping bag assembly.

With references now to the drawings, and in particular to FIGS. 1–4 thereof, a new air mattress sleeping bag assembly embodying the principles and concepts of the present invention and generally designed by the reference numeral 20 will be described.

Figure 3:
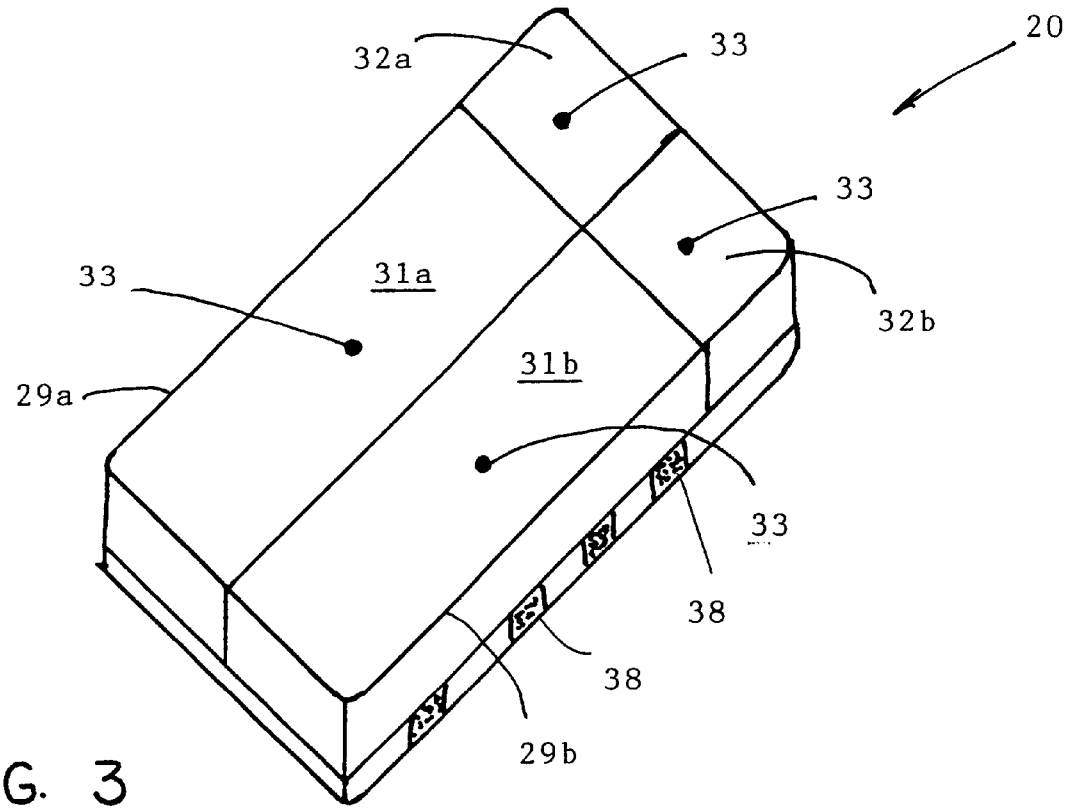
FIG. 3 is a perspective bottom view of the air mattress and the four intake ports.
Figure 4:
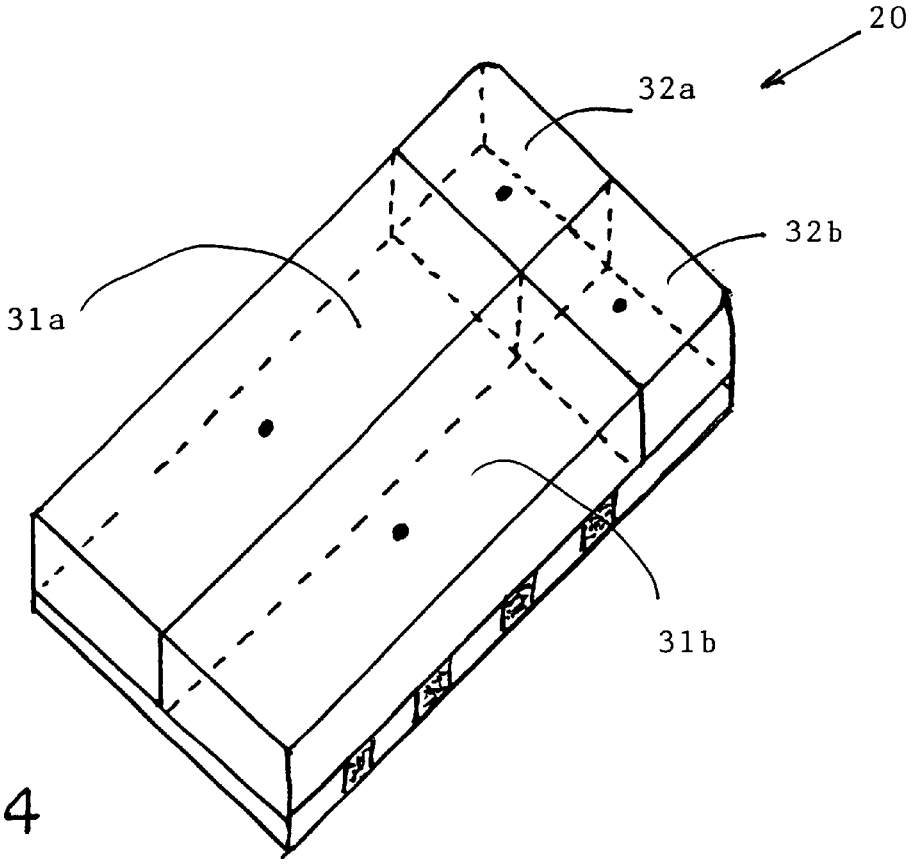
FIG. 4 is a perspective bottom view with cross-sectional segments defining the pneumatic chambers.

More specifically, it will be noted that the air mattress sleeping bag assembly 20 of FIG. 1 is comprised of first and second sleeping bag portions 21a and 21b and first and second air mattress portions 22*a* and 22*b*. The assembly 20 having a pillow end 23 and a foot end 24. Air mattress portions 22*a* and 22*b* having torso sections 29*a* and 29*b*, and pillow sections 30*a* and 30*b* respectively. These sections being isolated from each other by impervious membranes which define torso pneumatic chambers 31*a* and 31*b*, and pillow pneumatic chambers 32*a* and 32*b*. Each chamber having an air intake port 33 disposed in the lower surface 28 as depicted in FIG. 3. These ports 33 being of a conventional type as found in conventionally marketed air mattresses. Supporting first sleeping bag portion 21*a* is first air mattress portion 22*a*, wherein the pneumatic chambers 31*a* and 32*a* are separately inflated to a desired firmness thereby giving support and providing comfort to an associated individual positioned therewithin, in a spaced relationship relative to a ground surface therebeneath. By this structure, an individual can be comfortably supported whether the terrain be rough or uneven.

The second sleeping bag portion 21*b* and the non-inflated second air mattress portion 22*b* are utilized as a coverlet 37 for the individual, with a plurality of fastening strips 38 made from standard velcro-like hook and loop fastening materials attached to the perimeter of the sleeping bag portions 21*a* and 21*b* for securing the assembly in a closed position. In the event of a malfunction, puncture or any other damage to a chamber of first air mattress portion 22*a*, assembly 20 can be reversed, whereby the second air mattress portion 22*b* comprising torso section 29*b* and pillow section 30*b* can be inflated to support the second sleeping bag portion 21*b*. The opposing portions 21*a* and 22*a* now form the coverlet 37, thus providing a backup to the assembly 20. It is to be appreciated that in lieu of the velcro-like fastening strips 38, a standardized zipper (not shown) as often found in sleeping bags could be used equally as well.

Sleeping bag portions 21*a*, 21*b* contain an insulating amount of known fibrous material and conventional web materials. The top surface 25 of sleeping bag portions 21*a*, 21*b* having a material such as cotton or fleece to provide a measure of comfort. Mattress portions 22*a*, 22*b* are made from air tight layers of impermeable flexible plasicized material such as urethane coated nylon fabric or plastic coated cotton fabric. Other suitable material may be nylon of the non-rip type or relatively thick polyethylene film, desirably about 4 mils in thickness. Other suitable material would be impervious rubberized fabrics and saran type films.

As shown in FIGS. 1–4 the bottom surface 26 of the sleeping bag portions 21*a*, 21*b* are coupled with the upper surface 27 of the air mattress portions 22*a* and 22*b*, such that they cannot be separated from each other during use. This coupling can be either permanently affixed by well known methods of adhesive bonding or else can be removably coupled by locating patches of hook type material on the bottom surface 26 of the sleeping bag portion to be mated with loop type material on the opposing upper surface 27 of the mattress portion.

Figure 2:
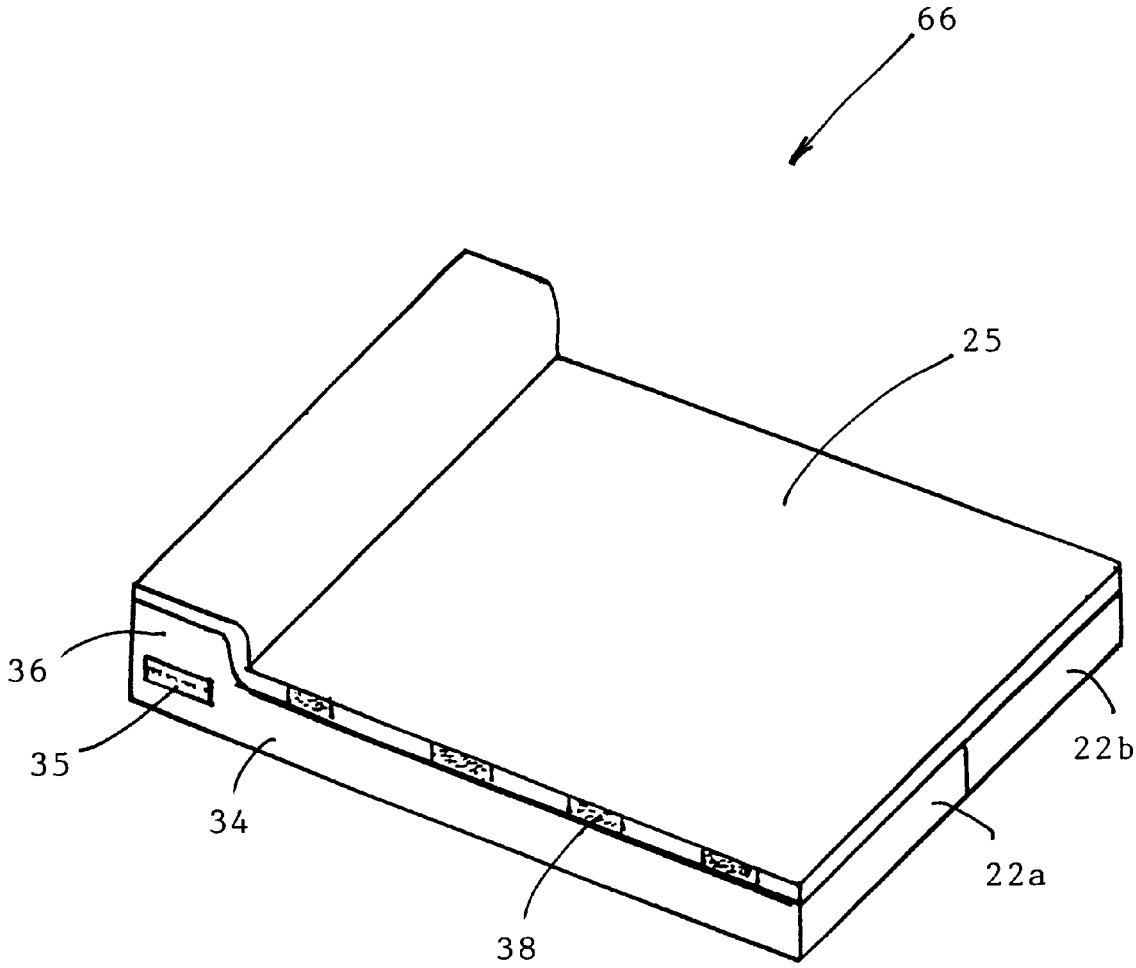
FIG. 2 is a perspective view of the assembly opened up to a full air mattress.

FIGS. 1 and 2 show a securing means 35 in the side section 34 of the first air mattress 21*a* which opens to a storage pocket 36. This securing means 35 is shown with a velcro-type fastener but could be fastened just as well with a zipper (not shown). A portable air inflation device 39 is stored within the pocket 36, since often on overnight camping trips, there is a lack of access to electrical power, thereby making it imperative that the assembly 20 have its own inflatable device 39. The present invention does also include an electrical cord 58 for use whenever electricity is available.

Figure 5:
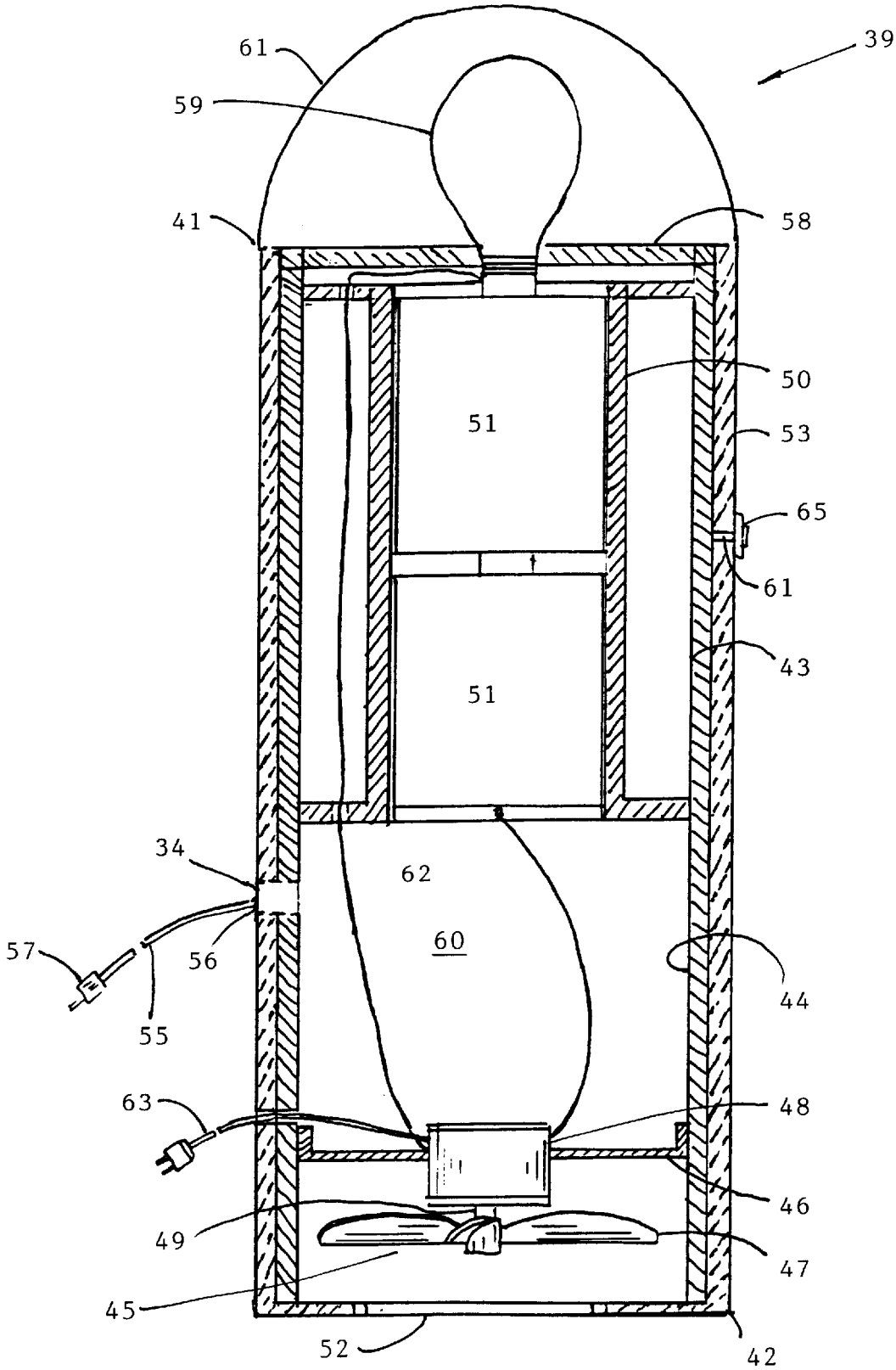
FIG. 5 is a cross sectional elevational view of the inflation device.

FIG. 5 shows inflation device 39 having a hollow cylindrical plastic housing 40 with a flashlight end 41 and an air intake end 42. Interposed within housing 40 is a removable cylindrical metal sleeve 43 having a highly conductive inner wall 44. Disposed within the sleeve 43 is a fan assembly 45 for drawing air into the device 39 through an intake opening 52 at the air intake end 42. The fan assembly 45 is generally to be a low h.p. unit and is comprised of a plurality of braces 46 which are biased quite forcibly against the metal sleeve 43. One end of a shaft 49 is integrally connected to a motor 48 for supplying power to a plurality of radially extending impellers blades 47 which are rotatively connected to the other end of the shaft 49. Interposed within sleeve 43 and below the fan assembly 45 is a cylindrical battery support bracket 50 for housing a plurality of batteries 51 which are arranged in series. For the present invention it is anticipated that two batteries will be needed. A pair of electrical connecting wires 62 carry the energizing power from the batteries 51 to the motor 48. One wire connecting the negative cathode of the batteries to the motor, the other wire connecting the positive anode of the batteries to the motor. A push button switch 65 is located on the exterior wall of the housing and is connected to the conductive sleeve 44 by a contact rod 64, whereby an individual can energize the system by engaging the push button 65 into the contact rod 64. Positioned within the sleeve 43 below the battery bracket 50 is a light bulb support 58, in which a light bulb is seated in the center thereof. The bulb 59 is in direct contact with the anode of the first battery 51 in series so as to also energized by the batteries 51. A transparent cover 61 is located at the flashlight end 41. The general concepts of the inflation device 39 are similar to those devices well known in the art. The radial impeller blades 47 draw air into the device 39 through the intake opening 52 to a void 60 within the housing and propel the air out of the device 39 through an exhaust vent 54 where the air is delivered to pneumatic chambers 31*a*, 31*b*, 32*a*, and 32*b* by an air tube 55. The air tube 55 having opposing ends, a proximal end 56 connecting to the exhaust vent 54 and a distal end 57 having conventional means for connecting to the air intake ports.

FIG. 2 depicts the assembly 20 opened up for use as a full size air mattress 66. Both first and second air mattress portions 22*a*, 22*b* are inflated, which gives the present invention a diversity not found in prior art devices.

In use, the air mattress sleeping bag assembly 20 can comfortably support and insulate an individual relative to ground surface. The pneumatic chambers 31*a*, 31*b*, 32*a*, and 32*b* can be selectively inflated to a desired firmness according to the personal preference of the individual. The assembly 20 can be conveniently stored in a deflated and folded condition, similarly to the manner in which most conventional sleeping bags are folded.

As to a further discussion of the manner of usage and operation of the present invention, the same should be apparent from the above description. Accordingly, no further discussion relating to the manner of usage and operation will be provided. With respect to the above description then, it is to be realized that the optimum dimensional relationships for the parts of the invention, to include variations in size, materials, shape, form, function and manner of operation, assembly and use, are deemed readily apparent and obvious to one skilled in the art. All equivalent relationships to those illustrated in the drawings and described in the specification are intended to be encompassed by the present invention.

Therefore, the foregoing is considered as illustrative only of the principles of the invention. Further, more numerous modifications and change will readily occur to those skilled in the art, it is not designed to limit the invention to the exact construction and operation shown and described, and accordingly, all suitable modifications and equivalents may be be said to fall within the scope of the invention.

LEGEND

20 Air mattress sleeping bag assembly
21*a* First sleeping bag portion
21*b* Second sleeping bag portion
22*a* First air mattress portion
22*b* Second air mattress portion
23 Pillow end
24 Foot end
25 Top surface of sleeping bag portion
26 Bottom surface of sleeping bag portion
27 Upper surface of mattress portion
28 Lower surface of mattress portion
29*a* Torso section of first air mattress portion
29*b* Torso section of second air mattress portion
30*a* Pillow section of first air mattress portion
30*b* Pillow section of second air mattress portion
31*a* First torso pneumatic chamber
31*b* Second torso pneumatic chamber
32*a* First pillow pneumatic chamber
32*b* Second pillow pneumatic chamber
33 Air intake ports
34 Side of first air mattress portion
35 Securing means for storage pocket
36 Storage pocket
37 Coverlet
38 Velcro fasten strips
39 Air inflation device
40 Hollow cylindrical housing
41 Flashlight end
42 Air intake end
43 Cylindrical metal sleeve
44 Conductive inner wall of sleeve
45 Fan assembly
46 Braces
47 Radial propeller blades rotatively connected to shaft
48 Motor
49 Shaft
50 Cylindrical battery support bracket
51 Batteries
52 Intake opening at fan end
53 Side surface of housing
54 Exhaust vent
55 Air tube
56 Proximal end
57 Distal end
58 Light bulb support
59 Light bulb
60 Void within housing
61 Transparent cover
62 Electrical connector wires
63 Electrical cord
64 Contact rod
65 Push button switch
66 Full size air mattress

What is claimed is:

1. An air mattress sleeping bag assembly comprising:

first and second sleeping bag portions, each having a top surface and a bottom surface;

first and second air mattress portions, each mattress portion having a separate air inflatable torso section and pillow section, each mattress portion having an upper surface and a lower surface;

means for coupling the upper surfaces of each of the mattress portions to the bottom surface of the sleeping bag portion;

the torso and pillow sections having pneumatic chambers defined therein, the chambers isolated from each other by impervious membranes;

air intake ports located in the lower surface of each torso and pillow section for introducing air from an air inflation means to the pneumatic chambers;

alternate coverlets formed by folding either the first sleeping bag portion over the second sleeping bag portion or the second sleeping bag portion over the first sleeping bag portion to form a space for positioning an individual therein; and means for fastening the sleeping bag portions together, whereby either of the air mattress portions may be pneumatically inflated to provide support for the individual positioned therein, the non-inflated air mattress portion and sleeping bag portion forming the coverlet.

2. The air mattress sleeping bag assembly according to claim 1, wherein the coupling means comprises patches of hook type fasteners on the bottom surfaces of the sleeping bag portions mating with loop type fasteners on the upper surfaces of the air mattress portions for a removable coupling.

3. The air mattress sleeping bag assembly according to claim 1, wherein the fastening means of the coverlet comprises a zipper disposed about the outer perimeter of the sleeping bag portions.

4. The air mattress sleeping bag assembly according to claim 1, wherein the fastening means of the coverlet comprises hook and loop fasteners, sufficiently spaced along the outer perimeter of the sleeping bag portions.

5. The air mattress sleeping bag assembly according to claim 4, wherein the first air mattress has means for securing a storage pocket, the pocket containing a portable, self powered inflation device.

6. The air mattress sleeping bag assembly according to claim 5, wherein the securing means is a zipper.

7. The air mattress sleeping bag assembly according to claim 5, wherein the securing means comprises a hook and loop type fastener strip.

8. The air mattress sleeping bag assembly according to claim 7, wherein the inflation device includes:

a hollow cylindrical housing having two ends, a flashlight end and an air intake end;

the flashlight end having a transparent cover;

the air intake end having an intake opening for the introduction of air into the device;

the housing having a void contained within for storing air;

the housing having a side surface defining an exhaust vent;

an air tube having two ends, a proximal end attached to the exhaust vent for receiving air from the void, a distal end having means for connecting to the air intake ports;

a cylindrical metal sleeve interposed within the housing, the sleeve having a highly conductive inner wall;

a fan assembly comprising:

a motor having a drive shaft;

a plurality of radial propeller fan blades rotatively connected to the drive shaft; and a plurality of braces extending outwardly from the motor, the braces having extremities biasing against the inner wall of the sleeve to support the fan assembly therein;

a generally cylindrical battery support bracket interposed within the sleeve, a plurality of batteries arranged in series contained within the bracket;

a pair of electrical wire connectors, one wire connecting a negative cathode of the battery to the motor, the other wire connecting a positive anode of the battery to the motor;

a light bulb support biased against the inner wall of the sleeve, a light bulb positioned therein, the light bulb having an electrical connection directly with the anode of the battery;

a contact rod; and a push button switch located on the exterior housing, whereby the individual can energize the device by engaging the push button thereby biasing the contact rod into making an electrical connection with the metal surface of the sleeve.

9. The air mattress sleeping bag assembly according to claim 8, wherein the inflation device includes an electrical cord for connecting to a 110/115 volt power outlet.

10. A pneumatically cushioned sleeping bag assembly having a capability of being used as either a conventional sleeping bag or as a full size air mattress, the assembly comprising:

a first and a second sleeping bag portion, each sleeping bag portion having a top surface and a bottom surface;

a first and a second mattress portion, each mattress portion having a separate air inflatable torso section and a separate pillow section, each mattress portion having an upper surface and a lower surface;

means for coupling the mattress portions to the sleeping bag portions;

the torso and pillow sections having pneumatic chambers defined therein, the chambers isolated from each other by impervious membranes;

air intake ports located in the lower surface of each section;

means for introducing air into the pneumatic chambers;

a coverlet formed by folding the first sleeping bag portion over the second sleeping bag portion to form a space for positioning an individual therein; and means for fastening the sleeping bag portions together, whereby the individual may either use the assembly as a sleeping bag by pneumatically inflating only the second air mattress portion while folding the first air mattress portion to form the coverlet, or the individual may inflate both air mattress portions to make a full size air mattress.

11. The assembly according to claim 10, wherein the coupling means comprises patches of hook type fasteners on the bottom surfaces of the sleeping bag portions, the hooks mating with loop fasteners on the upper surfaces of the air mattress portions for a removable coupling.

12. The assembly according to claim 10, wherein the fastening means of the coverlet comprises a zipper disposed about the sleeping bag perimeter.

13. The assembly according to claim 10, wherein the fastening means of the coverlet comprises hook and loop fasteners sufficiently spaced along the sleeping bag outer perimeter.

14. The assembly according to claim 13, wherein the first air mattress has means for securing a storage pocket, the pocket containing a portable self-powered inflation device.

15. The assembly according to claim 14 wherein the securing means comprises a hook and loop type fastener strip.

16. The assembly according to claim 14 wherein the securing means is a zipper.

17. The assembly according to claim 14, wherein the inflation device includes a battery powered motorized fan having means for connecting to the intake ports.

18. The assembly according to claim 14 wherein the inflation device includes an electrical cord for connecting to a 110/115 volt power outlet.

* * * * *